US006025024A

United States Patent [19]

Heindrichs et al.

[11] Patent Number: 6,025,024

[45] Date of Patent: Feb. 15, 2000

[54] PROCESS FOR GENERATING STRUCTURED SURFACES IN COIL COATING

[75] Inventors: Wielfried Heinz Heindrichs, Hilden; Dirk Lange, Monheim, both of Germany

[73] Assignee: Sigma Coatings Farben- und Lackwerke GmbH, Germany

[21] Appl. No.: 09/016,602

[22] Filed: Jan. 30, 1998

[30] Foreign Application Priority Data

Jan. 31, 1997 [BE] Belgium ..... 97101538

[51] Int. Cl.[7] ..... B05D 3/12; B05D 5/02

[52] U.S. Cl. ..... 427/278; 72/46; 427/178

[58] Field of Search ..... 427/278, 178; 72/46

[56] References Cited

U.S. PATENT DOCUMENTS

| | | | |
|---|---|---|---|
| 2,819,179 | 1/1958 | Barnard et al. | 427/278 |
| 3,207,617 | 9/1965 | Baker | 117/9 |
| 3,278,322 | 10/1966 | Harkins, Jr. et al. | 427/278 |
| 3,896,248 | 7/1975 | Scarpa | 428/172 |
| 4,293,599 | 10/1981 | Hori et al. | 427/274 |
| 4,353,949 | 10/1982 | Kyminas et al. | 427/278 |
| 4,612,152 | 9/1986 | Kawabata | 264/136 |
| 5,164,227 | 11/1992 | Miekka et al. | 427/278 |
| 5,565,260 | 10/1996 | Hawk | 428/195 |

FOREIGN PATENT DOCUMENTS

| | | | |
|---|---|---|---|
| 0079759 | 5/1983 | European Pat. Off. | B05C 9/12 |
| 8911343 | 11/1989 | European Pat. Off. | B05D 3/12 |
| 2289353 | 5/1976 | France | B41M 1/10 |
| 1064131 | 4/1967 | United Kingdom . | |
| 1512967 | 6/1978 | United Kingdom | B05D 3/12 |

*Primary Examiner*—Shrive Beck
*Assistant Examiner*—Kirsten A. Crockford
*Attorney, Agent, or Firm*—Michael J. Caddell; M. Norwood Cheairs

[57] ABSTRACT

Structured surfaces are generated in a coil coating line operating at least at 60 m/min by a process comprising the step of passing the wet layer of paint under a roll having a raised pattern on its surface that imparts a structure to the wet layer before heating to form a coating having a structured surface. The paint has a viscosity of 30 to 200 s (DIN 4 cup; DIN 53211).

6 Claims, No Drawings

PROCESS FOR GENERATING STRUCTURED SURFACES IN COIL COATING

CROSS REFERENCE TO RELATED APPLICATION

This application claims priority of a pending application filed in Belgium on Jan. 31, 1997, Application Number 97101538.3 to the same inventors as the present invention.

FIELD OF THE INVENTION

This invention relates to the generation of structured surfaces in coil coating. More particularly, the invention relates to a physical method for generating structured surfaces using coil coating.

BACKGROUND OF THE INVENTION

It is known in the art of coil coating that structured surfaces can be obtained by changing the chemical composition of the paint (see e.g. the papers by P. Kunze in Oberflaeche-JOT, 1991(7), pages 40, 42 and 43, and by L. Jandel presented at the Workshop Coil Coating of the BSHG AK Oberflachentechnik held on 30.06.94 at Giengen, Germany). Paint as used herein defines as well primers as topcoats or even tie coats.

The incorporation of large particles (i.e. of a size larger than the thickness of the dry paint layer) in the paint, in the form of inert or reactive pigments or fillers, gives a structured coating depending on the particle size.

The incorporation in the paint of an additive which provokes an incompatibility (whether in the paint or during the curing process) also gives a structured surface depending on the incompatibility.

EP-A-47508 to SCHRAMM Lacke discloses the use of a finely divided polyamide suspended in a thermosetting paint with a hydroxyl-functional binder and a blocked polyiscyanate.

EP-A-288294 to BASF Lacke+Farben discloses the use of 0.01 to 0.05 wt % of polyethylene wax having a softening point of 100–120° C. and a particle size of 5–35 um in the primer of certain polyester systems to obtain a structured finish.

DE-A-4019318 to BASF Lacke+Farben discloses the use of certain siloxanes in one or two-coat polyester compositions to obtain a structured surface.

The state of the art technology has many drawbacks. The main drawback is that changing the pattern of the structure requires changing the composition of the paint. Also, raw materials variability makes it difficult to reproduce the same structure from batch to batch. In addition, the structure pattern can in many cases be different in the web direction and in the transverse direction. Further, the systems based on the creation of an incompatibility are inherently subject to storage stability problems.

Mechanical means for making structured surfaces have already been proposed.

U.S. Pat. No. 5,565,260 discloses a method for applying polymer resin having a solids content of at least about 50 wt vol % with a coating roll having grooves in its surface.

U.S. Pat. No. 3,207,617 discloses a method for painting an embossed pattern on individual sheets of plywood, hardboard and the like, comprising applying a coat of liquid paint, mixing sand with said paint, and rolling a grooved roller to provide an embossed pattern.

FR-A-2,289,353 discloses a process for making an embossed coating on a substrate, wherein means for embossing are applied on a coating of a composition having a viscosity of 20 to 1,000 poises (dPa.s) whilst said coating in drying.

GB-1,512,967 discloses a process for making a decorative relief finish on a substrate such as a wall, using a pressing roll made of polyvinyl alcohol or polyvinyl acetal. The materials used to form the coatings are conventionally used in the building art to form thick films; exemplified materials have viscosities of 150 and 480 poise (dPa.s).

EP-A-79,759 discloses a method for providing surface replication in a coating on a sheet of material, wherein the coated sheet is at least partially set while it is pressed against a replicative surface. Such a process could not be adapted to coil coating because the continuous sheet must pass horizontally in the ovens These mechanical means have one or more of the following drawbacks:

- they demand the use of highly viscous coating compositions, which could not be used in coil coating;
- they cannot be used continuously, or where they can they have a low speed that cannot compare with the high speed of coil coating; and/or
- the structure has to be imparted during the drying step, what is obviously impossible in a coil coating oven.

There is thus a need in the art for a process for generating structured surfaces in coil coating which would not suffer from those drawbacks.

It is thus an object of the invention to provide a process for generating structured surfaces in coil coating that allows to change the structure pattern without having to change the paint composition.

It is another object of the invention to provide a process for generating structured surfaces in coil coating that will be essentially independent from the usual raw materials variability.

A further object of the invention is to provide a process for generating structured surfaces in coil coating that will not create paint storage stability problems.

These and other objects can be achieved by the process of the invention.

The process of the invention for generating a structured surface in coil coating comprises the successive steps of:

(a) applying a wet layer of a paint on a substrate, the paint having a viscosity of 30 to 200 s (as measured with a DIN 4 cup using DIN 53211 standard-method) and the substrate moving at a speed of at least 60 m/min;

(b) passing the wet layer of paint under a roll having a raised pattern on its surface that imparts a structure to the wet layer; then (c) heating the thus coated and rolled substrate to form the structured surface.

Coil coating is a continuous coating process of metal coils. The metal is generally steel, galvanised steel or aluminium. The coating is applied continuously on the metal moving at high speed, using roller or spraying applications and dried or cured by passing in a heated oven. The process involves metal pretreatment (such as degreasing, brushing, rinsing and chemical treatment, as may be required or desired) followed by the application and heating of two layers of coating (generally a primer and a topcoat). The coated metal can then be cut and given its final shape. Description of the coil coating process can be found in many textbooks, e.g. in "Organic Coatings: Science and Technology", vol.II, pages 290–5, Wicks et al., eds., Wiley, 1994.

The process of the invention can be applied to the primer and/or to the topcoat (or to any intermediate coat). When a primer is structured, it is known that it can be overcoated with a topcoat which essentially retains the structure imparted to the primer coat.

The wet layer of paint can be applied by any means used or useable in coil coating, such as bar coating, roller coating, curtain coating or extrusion. The wet film usually has a thickness of from 5 to 60 μm; for primers the wet film thickness is preferably of about 20 μm, while for topcoats it is preferably of about 50 μm.

The invention is applicable to any type of paint that can be used in coil coating, be it of the heat curing or of the heat drying type. As examples of binders, there can be cited epoxy resins, polyesters, polyurethanes, polyesterurethanes, silicone-polyesters, PVC plastisols and organosols, polyvinylidene fluoride (PVdF) homo- or copolymers, and hybrid formulations as well as mixtures. Paint formulation in coil coating is known in the art and need not be described herein.

As in any other coil coating process, the paint properties (such as the thixotropy, the viscosity, the curing reaction) need to be adapted to the specific operating conditions. The viscosity of the paint is typically in the range of 30 to 200 s (as measured with a DIN 4 cup; DIN 53211 standard method), preferably 50 to 150 s, more preferably 60 to 120 s.

The heating step of the coated substrate to cure the paint is well known in the art; more particularly, one of ordinary skill in the art knows how to adapt the heating conditions.

The wet layer of paint is passed under a roll having a raised pattern on its surface in order to impart a structure to the wet layer before heating it to cure the paint. The roll may be made of any material, such as steel, stainless steel, brass, rubber, or it may even comprise a rubber coating on a metal roll. The diameter of the roll is easily adapted to the linear speed of the coil; the diameter is typically of from 10 to 2000 mm.

The raised pattern may be regular or irregular, any pattern design may be used. Typical dimensions are in the range of from 0.2 to 100 mm for the pattern unit and independently from 0.1 to 50 mm for each of the raised and hollow parts of the pattern. One of the advantages of the invention over the prior art is that it allows to obtain patterns of practically any unit size, whereas the prior art only provides small unit sizes (lower than 1 mm).

The depth of the pattern can be of from 0.01 to 10 mm, depending on the desired structure.

The distance between the surface of the raised pattern and the adjacent surface of the substrate is adapted to the desired depth of the structure, with the usual accuracy required in coil coating.

The structure created in the wet layer of paint is fixed by the curing process in the heating step. Said heating step must follow within a short period of time, which essentially depends on the viscosity and thixotropy of the wet paint; the speed of the coil in the process of the invention being of at least 60 m/min, preferably at least 80 m/min, there is no difficulty in placing the roll sufficiently close to the location where the paint will be cured, so that the paint viscosities and thixotropies usual in coil coating can be used.

The invention is thus suitable for all standard primer, intermediate and top coating compositions that can be used in coil coating.

The process of the invention provides a coil coating system which is simple to use and does not require any modification of the composition of the paints. In addition, the pattern of the structure can be varied practically at will and without interfering with the properties of the coating, what is impossible when varying the composition of the paints A coil coating apparatus essentially comprises the following elements, in that order: a decoiler, a stitching or welding unit, an entry accumulator, a pretreatment zone, a first coating unit followed by an oven, a second coating unit followed by an oven, an exit accumulator, and a recoiling or shearing and stacking equipment.

The present invention also provides a coil coating apparatus characterised in that it comprises, between a coating unit and the oven following it, a roll having a raised pattern on its surface that is adapted to impart a structure to the wet layer of coating before it is heated.

This invention provides the first opportunity to adjust in a coil coating process the general image of the structure pattern, the dimension of the unit of a repeated motive and the slope of each single motive.

EXAMPLES

In all examples, the substrates were zinc plated steel with Bonder 1303 pre-treatment at thicknesses of 0.5 mm.

Example 1

The following primer was used:

(P1) heat-drying polyester primer based on saturated polyester resin:

| | |
|---|---|
| saturated polyester binder | 19.8 wt % (dry matter) |
| pigments | 23.1 wt % |
| solvents | 56.1 wt % |
| additives | 01.0 wt % |
| paint viscosity: 105 s | |

A 20 um thick wet layer of primer was applied on the substrate.

A steel roll (R1) having a diameter of 20 mm was covered with a rubber sheet with a raised pattern consisting of hexagones in a compact geometrical arrangement; the pattern unit dimension was of 0.9 mm, and the depth of the pattern was of 2 mm. The roll (R1) was rolled over the wet layer of paint which then passed in an oven; it took 35 s to reach the peak metal temperature (PMT) of 230° C. The structure imparted by the roll (R1) to the paint was preserved in the dry coating.

The structured primer was then overcoated with a 25 um thick wet layer of topcoat:

(P2) heat-curing polyesterurethane topcoat;

| | |
|---|---|
| saturated polyester | 24.7 wt % (dry matter) |
| hexamethoxymethylmelamine | 05.0 wt % |
| catalyst | 00.3 wt % |
| pigments | 30.0 wt % |
| solvents | 37.2 wt % |
| additives | 02.8 wt % |
| paint viscosity: 95 s | |

The twice coated substrate was then passed in an oven at a PMT of 240° C.

The structure imparted to the primer layer was retained by the topcoat layer.

Comparative Example A

Example 1 was repeated up to after passing the roll (R1) over the wet layer of primer. At room temperature, the structure imparted to the wet paint remained stable for about two minutes and disappeared after about ten minutes.

Example 2

The substrate was coated with a base layer of the paint described in example under the denomination P2, which was then cured at a PMT of 240° C. The dry layer thickness was of 10 um.

The first layer was then overcoated with a 30 urn thick wet layer of a topcoat having the following composition:

(P3) heat-curing polyesterurethane topcoat:

| | |
|---|---|
| saturated hydroxyfunctional polyester | 23.3 wt % (dry matter) |
| ketoxime-b1ocked isocyanate | 02.0 wt % (11.5% NCO) |
| catalyst | 01.1 wt % |
| pigments | 31.2 wt % |
| additives | 08.9 wt % |
| solvents | 33.5 wt % |
| paint viscosity: 105 s | |

There was used a plastic roller (R2) having a diameter of 80 mm and an irregular raised pattern 3 mm deep. It was rolled over the wet paint which was then passed in an oven; it took 40 s to reach the peak metal temperature (PMT) of 240° C. The structure imparted by the roll (R2) to the paint was preserved in the dry coating.

We claim:

1. Process for generating a structured surface in coil coating comprising the steps of:

(a) applying a wet layer of a paint on a substrate; and (b) heating the thus coated substrate to form a coating having a structured surface; characterised in that the paint has a viscosity of 30 to 200 seconds, the substrate is moving at a speed of at least 60 m/min, and the process comprises the additional step of passing the wet layer of paint under a roll having a raised pattern on its surface that imparts a structure to the wet layer before heating the coated substrate.

2. Process according to claim 1, wherein the paint is dried in the heating step.

3. Process according to claim 1, wherein the paint is thermosetting and is heat-cured in the heating step.

4. Process according to any one of claims 1 to 3, wherein the paint has a viscosity of 60 to 120 s.

5. Process according to any one of claims 1 to 3, wherein the substrate is moving at a speed of at least 80 m/min.

6. The process according to any one of claims 1 to 3 wherein the paint has a viscosity of 60 to 120 seconds and the substrate is moving at a speed of at least 80 meters per minute.

* * * * *